US007888576B2

(12) United States Patent
Usa et al.

(10) Patent No.: US 7,888,576 B2
(45) Date of Patent: Feb. 15, 2011

(54) ENSEMBLE SYSTEM

(75) Inventors: Satoshi Usa, Hamamatsu (JP); Tomomitsu Urai, Hamamatsu (JP)

(73) Assignee: Yamaha Corporation (JP)

( * ) Notice: Subject to any disclaimer, the term of this patent is extended or adjusted under 35 U.S.C. 154(b) by 237 days.

(21) Appl. No.: 12/088,430

(22) PCT Filed: Jul. 24, 2006

(86) PCT No.: PCT/JP2006/315075

§ 371 (c)(1),
(2), (4) Date: Mar. 27, 2008

(87) PCT Pub. No.: WO2007/037067

PCT Pub. Date: Apr. 5, 2007

(65) Prior Publication Data

US 2009/0151545 A1 Jun. 18, 2009

(30) Foreign Application Priority Data

Sep. 28, 2005 (JP) ..... 2005-281059

(51) Int. Cl.
*G10H 1/00* (2006.01)

(52) U.S. Cl. ..... 84/600; 84/609; 84/634; 84/650; 84/666

(58) Field of Classification Search ..... 84/600–602, 84/609, 610, 634, 649, 650, 666, 639
See application file for complete search history.

(56) References Cited

U.S. PATENT DOCUMENTS 3,808,936 A 5/1974 Shrader
3,823,637 A 7/1974 Scott (Continued)

FOREIGN PATENT DOCUMENTS

EP 0 933 906 A2 8/1999

(Continued)

OTHER PUBLICATIONS

International search report issued in corresponding PCT/JP2006/315075, dated Oct. 31, 2006.

(Continued)

*Primary Examiner*—David S. Warren
(74) *Attorney, Agent, or Firm*—Rossi, Kimms & McDowell LLP

(57) ABSTRACT

An ensemble system enabling even performer unskilled in playing a musical instrument to easily grasp the difference in tempo from the performance of the facilitator. The circle corresponding to the performance terminal "Facilitator" is indicated fixedly on the center line of the vertical lines. The circle corresponding to the performance terminal (for example, piano (1)) of each user moves horizontally correspondingly to the difference from the performance terminal "Facilitator". If the press of a key of performance terminal lags behind that of the performance terminal "Facilitator" by one bar, the circle moves left onto the vertical line next to the vertical center line. If the press of a key of the performance terminal lags behind that of the performance terminal "Facilitator" by half the bar (two beats), the circle moves left by half the interval between the vertical lines from the vertical center line. If the press of a key of the performance terminal leads that of the performance terminal "Facilitator", the circle moves right (FIG. 7).

8 Claims, 11 Drawing Sheets

U.S. PATENT DOCUMENTS

| | | | | |
|---|---|---|---|---|
| 3,895,555 | A | 7/1975 | Peterson et al. | |
| 3,919,913 | A | 11/1975 | Shrader | |
| 4,364,299 | A | 12/1982 | Nakada et al. | |
| 4,694,723 | A | 9/1987 | Shinohara et al. | |
| 4,781,099 | A | 11/1988 | Koike | |
| 5,002,491 | A * | 3/1991 | Abrahamson et al. | 434/322 |
| 5,728,960 | A * | 3/1998 | Sitrick | 84/477 R |
| 5,952,597 | A * | 9/1999 | Weinstock et al. | 84/609 |
| 5,980,261 | A | 11/1999 | Mino et al. | |
| 6,084,168 | A * | 7/2000 | Sitrick | 84/477 R |
| 6,198,034 | B1 * | 3/2001 | Beach et al. | 84/600 |
| 6,211,451 | B1 * | 4/2001 | Tohgi et al. | 84/470 R |
| 6,348,648 | B1 * | 2/2002 | Connick, Jr. | 84/477 R |
| 6,417,435 | B2 | 7/2002 | Chantzis et al. | |
| 6,438,611 | B1 | 8/2002 | Hara et al. | |
| 6,441,289 | B1 | 8/2002 | Shinsky | |
| 6,448,486 | B1 | 9/2002 | Shinsky | |
| 6,495,747 | B2 * | 12/2002 | Shimaya et al. | 84/477 R |
| 6,504,090 | B2 | 1/2003 | Tsai et al. | |
| 6,660,922 | B1 | 12/2003 | Roeder | |
| 6,751,439 | B2 * | 6/2004 | Tice et al. | 434/350 |
| 6,921,856 | B2 * | 7/2005 | Koseki | 84/603 |
| 6,995,311 | B2 | 2/2006 | Stevenson | |
| 7,074,999 | B2 * | 7/2006 | Sitrick et al. | 84/477 R |
| 7,098,392 | B2 * | 8/2006 | Sitrick et al. | 84/477 R |
| 7,157,638 | B1 * | 1/2007 | Sitrick | 84/477 R |
| 7,189,910 | B2 | 3/2007 | Hasegawa | |
| 7,297,856 | B2 * | 11/2007 | Sitrick | 84/477 R |
| 7,335,833 | B2 * | 2/2008 | Smith et al. | 84/601 |
| 7,423,213 | B2 * | 9/2008 | Sitrick | 84/477 R |
| 7,612,278 | B2 * | 11/2009 | Sitrick et al. | 84/609 |
| 2001/0007960 | A1 | 7/2001 | Yoshihara et al. | |
| 2001/0032539 | A1 | 10/2001 | Chantzis et al. | |
| 2002/0035916 | A1 | 3/2002 | Tsai et al. | |
| 2002/0144586 | A1 * | 10/2002 | Connick, Jr. | 84/478 |
| 2002/0157521 | A1 * | 10/2002 | Shahal | 84/477 R |
| 2002/0165921 | A1 | 11/2002 | Sapieyevski | |
| 2003/0000368 | A1 * | 1/2003 | Isozaki | 84/609 |
| 2003/0024375 | A1 * | 2/2003 | Sitrick | 84/477 R |
| 2003/0100965 | A1 * | 5/2003 | Sitrick et al. | 700/83 |
| 2003/0110925 | A1 * | 6/2003 | Sitrick et al. | 84/477 R |
| 2003/0110926 | A1 * | 6/2003 | Sitrick et al. | 84/477 R |
| 2003/0150317 | A1 * | 8/2003 | Hamilton | 84/477 R |
| 2003/0167904 | A1 | 9/2003 | Itoh | |
| 2003/0167906 | A1 | 9/2003 | Isozaki | |
| 2003/0177886 | A1 | 9/2003 | Koseki | |
| 2003/0182133 | A1 | 9/2003 | Kawashima et al. | |
| 2003/0188626 | A1 | 10/2003 | Kriechbaum et al. | |
| 2004/0055443 | A1 | 3/2004 | Nishitani et al. | |
| 2004/0112202 | A1 * | 6/2004 | Smith et al. | 84/609 |
| 2004/0187673 | A1 | 9/2004 | Stevenson | |
| 2004/0221708 | A1 | 11/2004 | Hasegawa | |
| 2004/0237756 | A1 | 12/2004 | Forbes | |
| 2005/0005761 | A1 | 1/2005 | Knudsen | |
| 2005/0120865 | A1 | 6/2005 | Tada et al. | |
| 2005/0172790 | A1 | 8/2005 | Tada | |
| 2005/0262989 | A1 | 12/2005 | Franzblau | |
| 2006/0117935 | A1 * | 6/2006 | Sitrick | 84/477 R |
| 2006/0213358 | A1 * | 9/2006 | Motsenbocker | 84/731 |
| 2006/0288842 | A1 * | 12/2006 | Sitrick et al. | 84/477 R |
| 2007/0089590 | A1 | 4/2007 | Katou | |
| 2008/0041217 | A1 | 2/2008 | Knudsen | |
| 2008/0060499 | A1 * | 3/2008 | Sitrick | 84/477 R |
| 2008/0065983 | A1 * | 3/2008 | Sitrick | 715/273 |
| 2008/0072156 | A1 * | 3/2008 | Sitrick | 715/733 |
| 2008/0134861 | A1 * | 6/2008 | Pearson | 84/470 R |
| 2009/0044685 | A1 | 2/2009 | Usa et al. | |

FOREIGN PATENT DOCUMENTS

| | | | |
|---|---|---|---|
| EP | 1 553 556 | A1 | 7/2005 |
| EP | 1 562 175 | A1 | 8/2005 |
| EP | 1 926 080 | A1 | 5/2008 |
| JP | 8-16160 | A | 1/1996 |
| JP | 2000-276141 | A | 10/2000 |
| JP | 2001-337675 | A | 12/2001 |
| JP | 2002-91290 | A | 3/2002 |
| JP | 2002-132137 | A | 5/2002 |
| JP | 2003-84760 | A | 3/2003 |
| JP | 2003-288077 | A | 10/2003 |
| JP | 2004-093613 | A | 3/2004 |
| JP | 2004-184757 | A | 7/2004 |
| JP | 2005-62697 | A | 3/2005 |
| JP | 2005-165078 | A | 6/2005 |
| JP | 2005-250053 | A | 9/2005 |
| KR | 10-1996-0702658 | A | 4/1996 |
| KR | 10-2001-0109498 | A | 12/2001 |
| KR | 10-2003-0076405 | A | 9/2003 |
| WO | 9428539 | A2 | 12/1994 |
| WO | 0193261 | A1 | 12/2001 |

OTHER PUBLICATIONS

International Search Report issued in PCT/JP2006/315070, which corresponds to related co-pending U.S. Appl. No. 12/066,519.

Specification and drawings of un-published related co-pending U.S. Appl. No. 12/066,519, filed Mar. 12, 2008. "Ensemble System"; Satoshi USA et al.

International Search Report issued in PCT/JP2006/315077, dated Oct. 31, 2006, which corresponds to related co-pending U.S. Appl. No. 12/088,306.

Specification and drawings of un-published related co-pending U.S. Appl. No. 12/088,306, filed Mar. 27, 2008. "Ensemble System"; Satoshi USA et al.

English translation of the International Preliminary Report issued in application No. PCT/JP2006/315070 relating to co-pending U.S. Appl. No. 12/066,519, mailed Mar. 27, 2088.

English translation of the International Preliminary Report issued in corresponding application No. PCT/JP2006/315075 dated Apr. 10, 2008.

English translation of the International Preliminary report corresponding to related co-pending U.S. Appl. No. 12/088,306, dated Apr. 10, 2008.

Korean Office Action for Application No. 10-2008-7007402, "Ensemble System", Jul. 29, 2009. (Partial Translation).

Korean Office Action for Application No. 10-2008-7008627, "Ensemble System", Jul. 30, 2009 (Partial Translation).

Extended European Search Report issued in corresponding European Patent Application No. 06768386.2 dated Jul. 7, 2010, which corresponds to related co-pending U.S. Appl. No. 12/088,306.

Extended European Search Report issued in corresponding European Patent Application No. 06768384.7 dated Jul. 13, 2010.

Extended European Search Report issued in corresponding European Patent Application No. 06768379.7 dated Jun. 25, 2010, which corresponds to related co-pending U.S. Appl. No. 12/066,519.

* cited by examiner

FIG. 5

PART ASSIGNMENT TABLE

| PART ID | MIDI PORT |
|---|---|
| 1 | 0 (FACILITATOR) |
| 2 | 1 (PIANO 1) |
| 3 | 2 (PIANO 2) |
| 4 | 3 (PIANO 3) |
| 5 | 4 (PIANO 4) |
| 6 | 5 (PIANO 5) |

ENSEMBLE SYSTEM

This application is a U.S. National Phase Application of PCT International Application PCT/JP2006/315075 filed on Jul. 24, 2006 which is based on and claims priority from JP 2005-281059 filed on Sep. 28, 2005, the contents of which is incorporated herein in its entirety by reference.

TECHNICAL FIELD

The present invention relates to an ensemble system enabling even a performer unfamiliar with playing a musical instrument to easily participate in an ensemble performance, and more particularly, to an ensemble system enabling each of participants to easily recognize, during an ensemble performance, his/her own deviation in playing performance.

BACKGROUND ART

Conventionally, there is known an electronic musical instrument for generating music sounds according to performer's operation. In general, such an instrument is modeled on, e.g., piano, and designed to be operated similarly to a natural piano instrument. Therefore, some level of skill is needed to play the instrument and a long time is required to acquire proficiency in playing it.

In recent years, however, there is a demand that a performer unfamiliar with operating a musical instrument should be permitted to play a piece of music. Also, there is a demand that not only a performer can enjoy playing music, but also many performers can participate in and achieve an ensemble performance.

To this end, there has been proposed in, for example, Japanese Laid-open Patent Publication No. 2000-276141, an electronic musical instrument enabling a plurality of users unfamiliar with playing a musical instrument to participate in playing music. With this electronic musical instrument, users are enabled to implement an ensemble performance by making some easy actions (such as waving their hands). However, in the case of an ensemble performance being performed by a plurality of users unfamiliar with musical instrument operation, a deviation in playing performance can occur between the users, which poses a problem.

To eliminate such a deviation in performance, a musical performance assisting apparatus has been proposed in which a deference in tempo between a user's performance and musical score data is detected and the detected difference is displayed on a musical score (see, for example, in Japanese Laid-open Patent Publication No. 2001-337675). Also, there has been proposed a musical performance display apparatus, in which a history of timing of model performance and a history of timing of user's performance are displayed on a display screen, thereby comprehensively showing a difference relative to the model performance (see, for example, Japanese Laid-open Publication No. 2002-91290).

The above described performance assisting apparatus and the performance display apparatus are adapted to display a deviation relative to musical score data or model performance (demonstrative performance). These apparatuses are for individual use by users for making progress in playing performance.

In a case where a plurality of users (participants) perform rehabilitation or other activity together, as described in the aforementioned Japanese Laid-open Patent Publication No. 2000-276141, they are often divided into groups each consisting of a predetermined number of users (about five users, for example) including a facilitator (guide) who guides other participants. In that case, each participant plays music in time with the facilitator's performance. With the performance assisting apparatus and the performance display apparatus, a deviation relative to musical score data or mechanical demonstrative performance can be displayed, however, a deviation relative to a human musical performance performed by a facilitator or other human guide cannot be displayed.

The object of the present invention is to provide an ensemble system enabling even a performer unfamiliar with operating a musical instrument to easily grasp a deviation of a performer's performance from a facilitator's performance.

DISCLOSURE OF THE INVENTION

To achieve the above object, an ensemble system of this invention comprises a plurality of performance terminals each having at least one performance operator unit used for performance operation, at least one tone generator, and a controller connected to the plurality of performance terminals and the at least one tone generator and adapted to control each of the performance terminals, wherein the controller includes storage means adapted to store music data for performance including a plurality of performance parts, operation means adapted to give instructions to start and complete a performance, performance control means adapted to assign the plurality of performance parts to respective ones of the plurality of performance terminals, read out the performance part assigned to each of the performance terminals in accordance with a way in which the performance operator unit of each of the performance terminals is operated, and output data representing the read-out performance part to the tone generator, deviation detecting means adapted to detect a deviation between progression of readout of the performance part assigned to a guiding performance terminal among the plurality of performance terminals and progression of readout of the performance part assigned to each of other performance terminals, and display means adapted to display the deviation between the progresses.

In this invention, an instruction to start a performance is given by some user via the operation means of the controller, and a performance operation is carried out by each user using the performance operator unit of the performance terminal concerned. The performance operator unit of each performance terminal is comprised of a keyboard of an electronic piano, for example. Upon key depression on any of the keyboards, an operation signal is transmitted to the controller. Based on the received operation signal, the controller transmits a sounding instruction to the tone generator. In response to the sounding instruction, music sound is sounded by the tone generator. One of the performance terminals is for use by a facilitator. When input with the operation signal from any of the performance terminals, the controller detects a deviation between the number of times of input from the operated performance terminal and the number of times of input from a guiding performance terminal (for example, the performance terminal for use by the facilitator) (detects a difference between the two performance terminals in the number of times of key depression from the head of a piece of music). A deviation of each performance terminal in the number of times of key depression is displayed on a display unit such as a display.

Preferably, the tone generator is built in each of the plurality of performance terminals, and the performance control means of the controller is adapted to output data of the read-out performance part to the tone generator built in the performance terminal to which the performance part is assigned.

With this preferred embodiment, based on an operation signal received from a performance terminal, the controller reads out the performance part assigned to the performance terminal and transmits data of the read-out performance part to the tone generator built in that performance terminal. Music sound is sounded by the built-in tone generator of the performance terminal in accordance with a received sounding instruction. As a result, each of the performance parts is sounded by the performance terminal to which the performance part is assigned.

Preferably, the controller further includes fast-forward instruction means adapted to give a fast-forward instruction for at least one performance part assigned to at least one of the performance terminals, and the performance control means of the controller is adapted to read out at a high speed the performance part assigned to the at least one of the performance terminals when the fast-forward instruction is given by the fast-forward instruction means.

In this preferred embodiment, when a fast-forward instruction is given, the controller reads out the performance part for at least one performance terminal concerned at a high speed, and transmits data of the read out performance part to the tone generator. Since music sound is sounded by the tone generator in accordance with the data of the performance part read out at a high speed, sounding is carried out in fast forward, whereby the user concerned is enabled, whenever necessary, to catch up with neighboring performers in terms of playing performance. The fast-forward instruction can be given, with all the performance terminals, including the guiding performance terminal, simultaneously designated.

Preferably, each of the performance terminals includes terminal fast-forward instruction means adapted to give a fast-forward instruction for the performance part assigned to each of the performance terminals, and the performance control means of the controller is adapted, when given the fast-forward instruction, to read out at a high speed the performance data assigned to that performance terminal which has the terminal fast-forward instruction means from which the fast-forward instruction has been given.

With this preferred embodiment, when a fast-forward instruction is given by one of the performance terminals to the one performance terminal per se, the controller reads out the performance part of the one performance terminal at a high speed, and transmits data of the read out performance part to the tone generator. Since music sound is sounded by the tone generator in accordance with the data of the performance part read out at a high speed, sounding is carried out in fast-forward, whereby the user concerned can catch up with neighboring performers in term of playing performance, whenever necessary.

Preferably, the controller further includes rewind instruction means adapted to give a rewind instruction for at least one performance part assigned to at least one of the performance terminals, and the performance control means of the controller is adapted, when given the rewind instruction by the rewind instruction means, to read out in a reverse sequence the performance part for the at least one of the performance terminals which was read out in past time.

With this preferred embodiment, when a rewind instruction is given, the controller reads out the performance part of the performance terminal concerned in a reverse time sequence, and transmits data of the read out performance part to the tone generator. Thus, sounding by the tone generator is performed in a sequence reverse from the normal and rewind playback is carried out, whereby timing of a user's performance can be returned to current timing when the user's performance excessively leads performances being performed by neighboring performers.

Preferably, each of the performance terminals includes terminal rewind instruction means adapted to give a rewind instruction for the performance part assigned to each of the performance terminals, and the performance control means of the controller is adapted to read out, in a reverse sequence, that performance part for the performance terminal concerned which was read out in past time, when the rewind instruction is given by the terminal rewind instruction means.

With this preferred embodiment, when a rewind instruction is given by one of the performance terminals to the one performance terminal per se, the controller reads out the performance part for the one performance terminal in reverse time sequence and transmits data of the read out performance part to the tone generator. Sounding is performed by the tone generator in a sequence reverse to the normal and rewind playback is performed, whereby timing of a user's performance can be returned to current timing when the user's performance excessively leads performances being performed by neighboring performers.

Preferably, the controller includes deviation correcting instruction means adapted to give an instruction to eliminate deviation in performance between at least one of the performance terminals and the guiding performance terminal, and the performance control means of the controller is adapted, when given the instruction to eliminate deviation in performance by the deviation correcting instruction means, to read out the performance part assigned to the at least one of the performance terminals such as to make progress of readout of the performance part assigned to the at least one of the performance terminals to be coincident with progress of readout of the performance part assigned to the guiding performance terminal.

With this preferred embodiment, the controller can eliminate a deviation in performance between a user's (educand's) performance terminal and the guiding performance terminal, whenever necessary.

Preferably, each of the performance terminals includes terminal deviation correcting instruction means to give an instruction to eliminate deviation in performance between each of the performance terminals and the guiding performance terminal, and the performance control means of the controller is adapted, when given the instruction to eliminate deviation in performance by one of the terminal deviation correcting instruction means, to read out performance part assigned to the performance terminal concerned such as to make progress of readout of the performance part assigned to the performance terminal concerned to be coincident with progress of readout of the performance part assigned to the guiding performance terminal.

With this preferred embodiment, a deviation in performance between a user's (educand's) performance terminal and the guiding performance terminal can be eliminated in the performance terminal concerned, whenever necessary.

BRIEF DESCRIPTION OF DRAWINGS

FIG. 5 is a view showing an example of a part assignment table;

BEST MODE FOR CARRYING OUT THE INVENTION

In the following, an embodiment of this invention will be described in detail with reference to the drawings.

Figure 1:
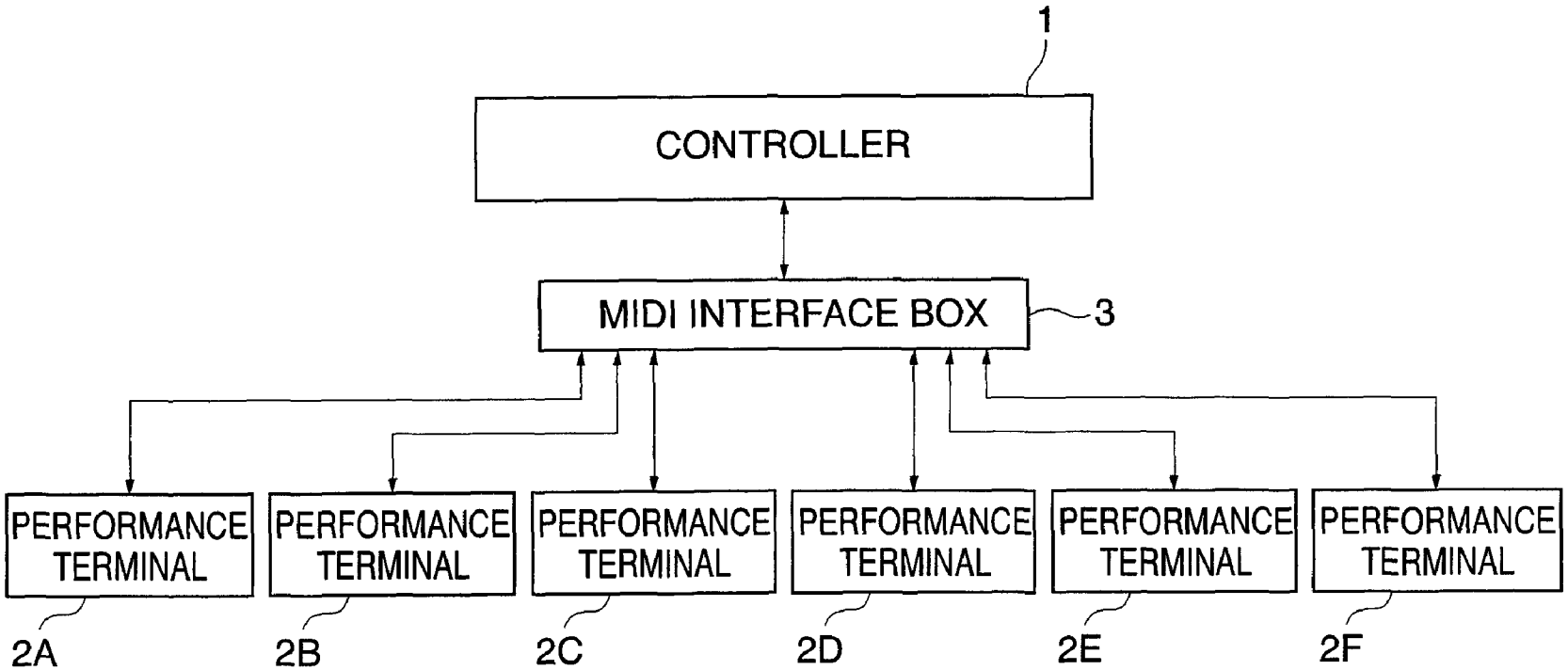
FIG. 1 is a block diagram showing the construction of a performance system.

FIG. 1 is a block diagram showing the construction of an ensemble system. As shown in FIG. 1, the ensemble system includes a controller 1 and a plurality of (six in FIG. 1) performance terminals 2A to 2F connected to the controller 1 via a MIDI interface box 3. Among the performance terminals 2, the performance terminal 2A is for use by a facilitator (guide), and the performance terminals 2B to 2F are for use by participants (educands). Five participants using the performance terminals 2B to 2F always use the same performance terminals 2, whereby the facilitator can identify the participants based on the performance terminals used by them.

The controller 1 is implemented by, for example, a personal computer, and controls the performance terminals 2 and collects data using software installed thereon. The controller 1 stores pieces of music data for performance each consisting of a plurality of performance parts. These parts include one or more melody parts, rhythm parts, accompaniment parts, and so on. The controller 1 includes a communication unit 11, described below, for transmitting sounding data for a part (or parts) to a corresponding one or ones of the performance terminals 2.

The performance terminals 2 are used by users to implement performance operations, and generate music sounds in accordance with users performance operations. Each of the performance terminals is constituted by, for example, an electronic piano or some other electronic keyboard instrument. In this embodiment, using the MIDI interface box 3 USB-connected to the controller 1, the performance terminals 2 are connected via separate MIDI systems. In FIG. 1, the performance terminal 2A is for use by the facilitator, and the performance terminal for the facilitator is specified by the controller 1. The performance terminals 2 are not limited to electronic pianos but may be other forms of electronic musical instruments such as electronic guitars, and in appearance, these terminals may not be limited to natural musical instruments but may be terminals each simply having an operator unit such as button.

It should be noted that the performance terminals 2 are not limited to those each having a tone generator incorporated therein. Alternatively, one or more independent tone generators can be connected to the controller 1. In that case, a single or as many tone generators as the performance terminals 2 may be connected to the controller 1. If as many tone generators as the performance terminals 2 are connected, these tone generators are respectively assigned to the performance terminals 2, and parts of music data for performance are assigned by the controller 1.

In the ensemble system, performance parts of music data for performance stored in the controller 1 are respectively assigned to the performance terminals 2, and each performance terminal 2 carries out an automatic performance of the performance part uniquely assigned thereto. When a performance operation (for example, key depression on the electronic piano) is performed by any of users of the performance terminals 2, instructions on tempo and timing are transmitted to the controller 1. Based on the input instructions on tempo and timing, a sounding instruction to sound notes of the performance part assigned to the performance terminal 2 is transmitted from the controller 1 to the performance terminal 2. An automatic performance is performed by the performance terminal 2 based on the sounding instruction received. Educands who are using the performance terminals 2 adjust tempos such as to match the tempo of the facilitator, whereby an ensemble performance is realized. The following is a detailed description of the constructions of the controller 1 and the performance terminal 2.

Figure 2:
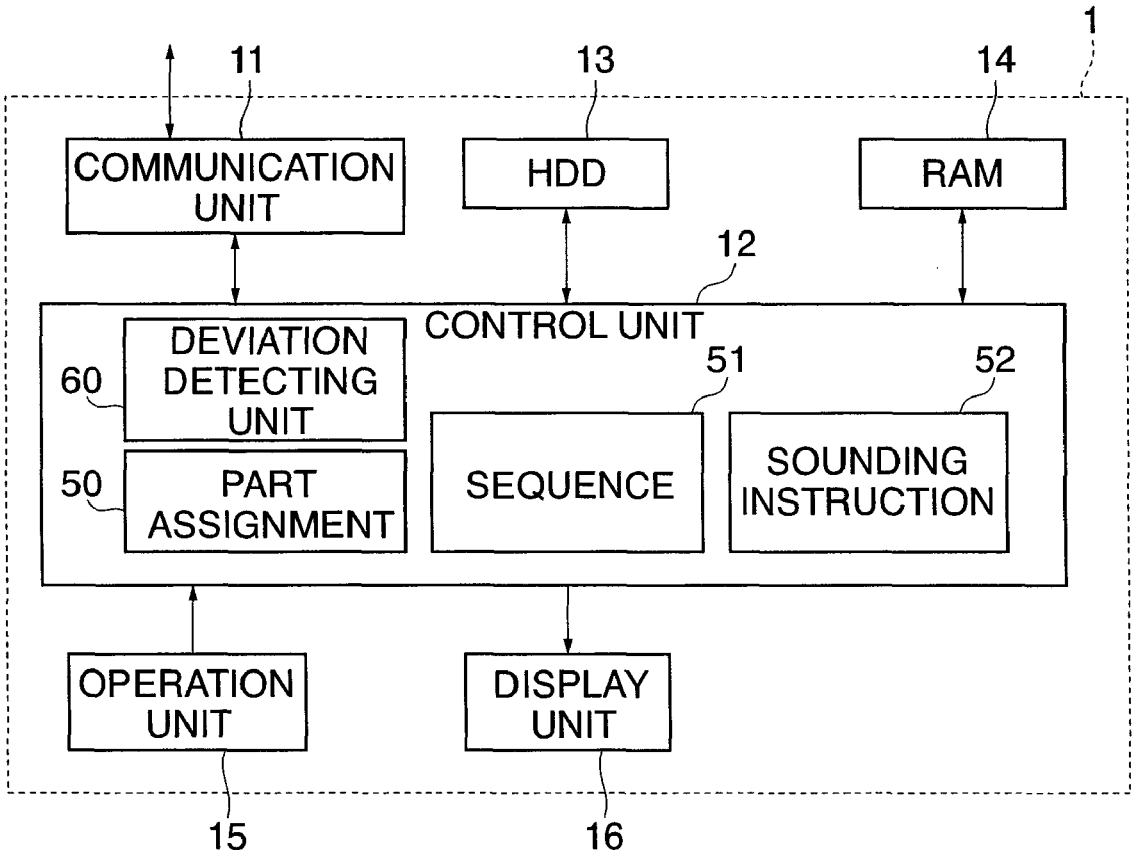
FIG. 2 is a block diagram showing the construction of a controller.

FIG. 2 is a block diagram showing the construction of the controller 1. As shown in FIG. 2, the controller 1 includes a communication unit 11, a control unit 12, an HDD 13, a RAM 14, an operation unit 15, and a display unit 16. The communication unit 11, HDD 13, RAM 14, operation unit 15, and display unit 16 are connected to the control unit 12.

The communication unit 11 is a circuit unit that communicates with the performance terminals 2, and has a USB interface (not shown). The MIDI interface box 3 is connected to the USB interface. The communication unit 11 communicates with the six performance terminals 2 via the MIDI interface box 3 and MIDI cables. The HDD 13 stores an operating program for the controller 1 and music data for performance consisting of a plurality of parts.

The control unit 12 reads out the operating program stored in the HDD 13, develops it in the RAM 14 as a work memory, and executes apart assignment process 50, a sequence process 51, a sounding instruction process 52, etc. In the part assignment process 50, the control unit 12 assigns the performance parts of music data for performance to respective ones of the performance terminals 2. In the sequence process 51, the control unit 12 sequences each performance part of the music data for performance (determines the pitch, length, etc. of each sound) according to the instructions on tempo and timing received from the corresponding performance terminal 2. In the sounding instruction process 52, the control unit 12 transmits, as sounding instruction data, the pitch, length, etc. of each sound determined in the sequence process 51 to the corresponding performance terminal 2.

The control unit 12 includes a deviation detecting unit 60 for detecting a deviation between beats (key depression timings) at the performance terminals.

The operation unit 15 is used by some user (mainly by the facilitator) to give instructions on operations of the present performance system. The facilitator operates the operation unit 15, whereby music data for performance is designated, and performance parts for respective performance terminals 2 are assigned, and so on. The display unit 16 includes a display (monitor). The facilitator and the participants conduct performance operations while watching the display unit 16 on which various information for an ensemble performance are displayed, as will be described in detail below.

Figure 3:
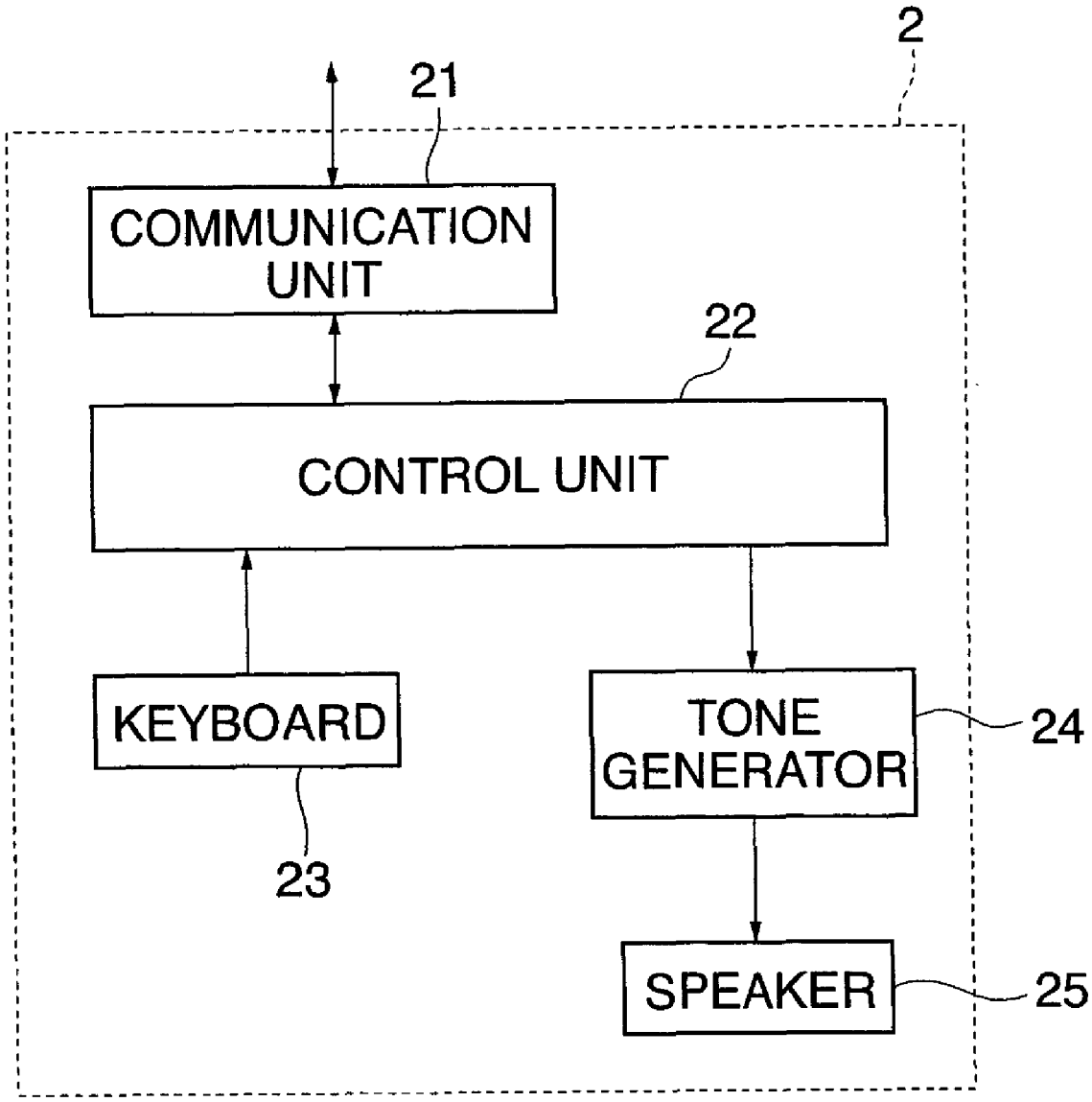
FIG. 3 is a block diagram showing the construction of a performance terminal.

FIG. 3 is a block diagram showing the construction of the performance terminal 2. As shown in FIG. 3, the performance terminal 2 includes a communication unit 21, a control unit 22, a keyboard 23 as a performance operator unit, a tone generator 24, and a speaker 25. The communication unit 21, keyboard 23, and tone generator 24 are connected to the control unit 22. The speaker 25 is connected to the tone generator 24.

The communication unit 21 is a MIDI interface and communicates with the controller 1 via a MIDI cable. The control unit 22 centrally controls the performance terminal 2. The keyboard 23 has, for example, 61 or 88 keys and can play in 5 to 7 octaves. The present ensemble system only uses data about Note On/Note Off messages and key depression intensity (Velocity), without distinction between keys. To this end, each key includes a sensor for detecting on/off and a sensor for detecting the intensity of key depression. The keyboard 23 outputs an operation signal to the controller 22 according to a key operation state (e.g., which key is depressed at what intensity). The control unit 22 transmits a Note On or Note Off message to the controller 1 via the communication unit 21 based on the input operation signal. The tone generator 24 generates a sound waveform under the control of the control unit 22 and outputs it as an audio signal to the speaker 25. The speaker 25 reproduces the audio signal input from the tone generator 24 to produce music sound. As described above, the tone generator and the speaker may not be incorporated in the performance terminal 2. The tone generator 24 and the speaker 25 may be connected to the controller 1 so that music sounds are sounded from a place different from where the performance terminal 2 is located. While as many tone generators as the performance terminals 2 may be connected to the controller 1, a single tone generator may be used.

In the above-described operation, when a key of the keyboard 23 is depressed, the control unit 22 transmits a Note On/Note Off message to the controller 1 (Local Off) and produces music sound according to an instruction from the controller 1 rather than according to a note message from the keyboard 23. Aside from the above described operations, the performance terminal 2 may be used as a general electronic musical instrument. When a key of the keyboard 23 is depressed, the control unit 22 may not transmit a note message to the controller 1 (Local On), but instruct the tone generator 24 to produce music sound based on the note message. Switching between Local On and Local Off may be performed by the user using the operation unit 15 of the controller 1 or using a terminal operation unit (not shown) on the performance terminal 2. It is also possible to set only some keyboards to Local Off and the other keyboards to Local On.

Figure 4:
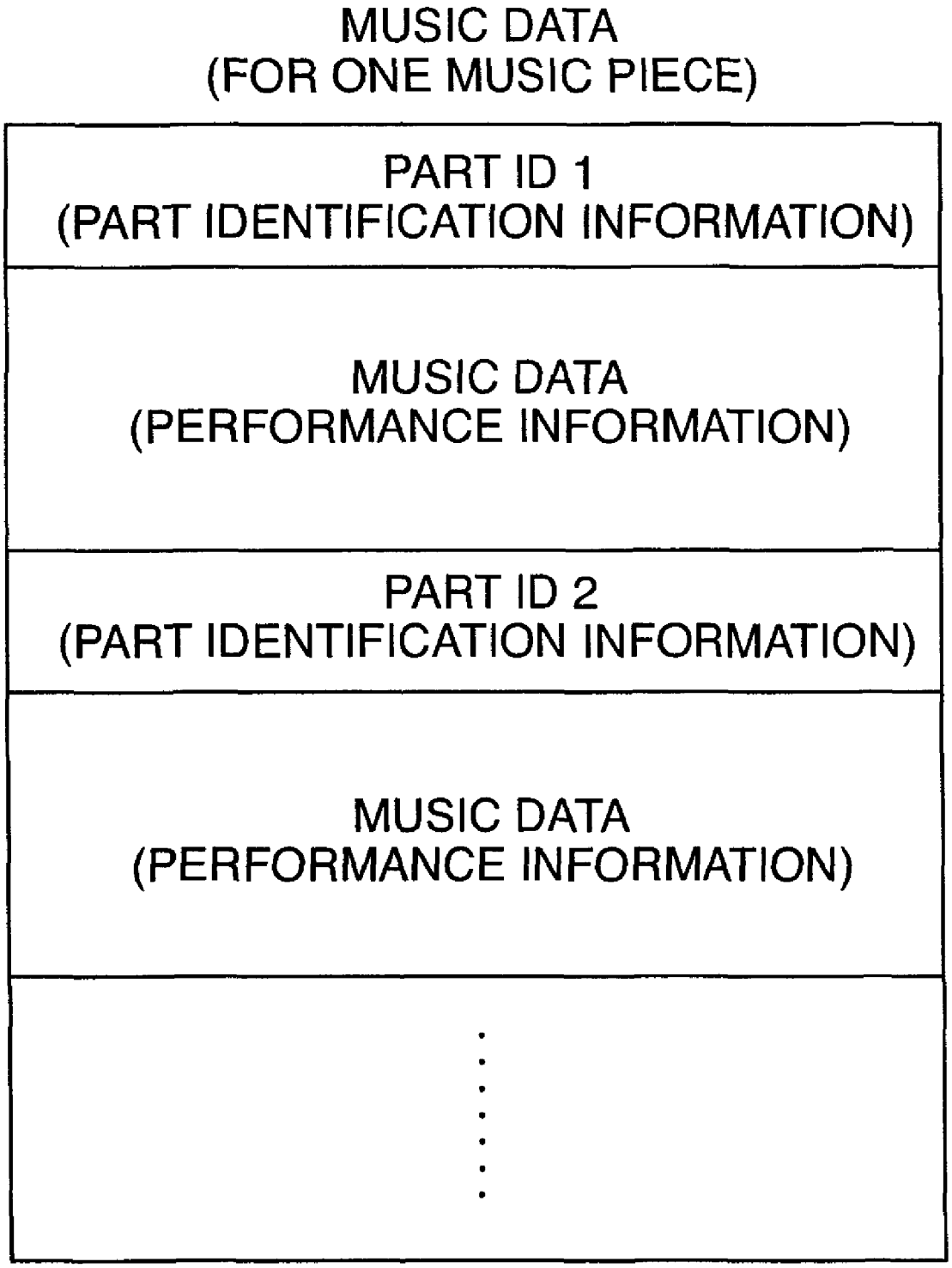
FIG. 4 is a view showing an example of music data.

The following is an explanation of operations for implementing an ensemble performance using the above described ensemble system. Some user (in particular, the facilitator) selects music data for performance using the operation unit 15 of the controller 1. The music data for performance is data (standard MIDI) prepared in advance based on the MIDI standard and stored in the HDD 13 of the controller 1. An example of such music data is shown in FIG. 4. As shown in FIG. 4, the music data includes a plurality of performance parts, and includes pieces of identification information that identify respective ones of the performance parts, and pieces of performance information about the performance parts.

When music data for performance is selected by some user, the controller 1 assigns performance parts to respective ones of the performance terminals 2 connected thereto. Which performance part should be assigned to which performance terminal is specified beforehand in a table. FIG. 5 is a view showing an example of the performance part assignment table. As shown in FIG. 5, MIDI port 0 (performance terminal for facilitator) corresponds to performance part 1. The performance part 1 is assigned to, for example, the performance terminal 2A in FIG. 1. Each MIDI port represents a port number in the MIDI interface box 3. Each performance terminal 2 is identified by the MIDI port to which it is connected. MIDI port 1 (piano 1) corresponds to performance part 2, which is assigned to, for example, the performance terminal 2B in FIG. 1. Ditto for the others. In this manner, the performance parts are automatically assigned to respective ones of the performance terminals 2. The performance part assignment table is registered beforehand in the HDD 13 of the controller 1 by the facilitator. Alternatively, the facilitator can make a manual selection using the operation unit 15 of the controller 1.

If the performance terminals 2 are connected to USB ports, the performance terminals 2 may be identified by USB port numbers.

A performance-start standby instruction is input by the facilitator via the operation unit 15 of the controller 1 after the music data for performance is selected by the facilitator and the performance parts are assigned by the controller 1 to respective ones of the performance terminals 2. The term "performance-start standby" does not indicate that music sound is actually produced, but indicates that the controller 1 reads out the music data for performance from the HDD 13 to the RAM 14 to thereby prepare for performance operation.

When the performance-start standby instruction is input to the operation unit 15 and the preparation for performance is completed by the controller 1, the performance terminals 2 are made ready for performance. With the present ensemble system, performance operations are implemented by a plurality of users in time with the facilitator's (ensemble leader's) performance. Since the users do not conduct performances in time with an exemplar performance (mechanic demonstrative performance), but in time with the facilitator's performance (human performance), they can have a sense of actually participating in an ensemble performance.

The following is an explanation of operations of the ensemble system during an ensemble performance. When the operator unit (keyboard) 23 of any of the performance terminals 2 is depressed by the user with a finger, the controller 22 transmits a Note On message to the controller 1 according to the intensity of key depression. The Note On message contains information representing the key depression intensity (Velocity), etc. When the keyboard 23 is released (the finger is lifted), the controller 22 transmits a Note Off message to the controller 1. Based on the Note On and Note Off messages received from the performance terminal 2, the controller 1 determines the pitch, length, etc. of each sound in the music data for performance of a predetermined length (e.g., for one beat) among the performance part assigned to the performance terminal 2, and transmits music data for performance having the determined pitch, length, etc. to the performance terminal 2, as sounding instruction data. The sounding instruction data includes sounding timing, length, intensity, tone color, effect, pitch change (pitch bend), tempo, and so on.

Based on a time period from when the Note On message has been received to when the Note Off message has been received, the controller 1 determines the sounding instruction data. Specifically, when the Note On message is input, the controller 1 reads out the corresponding performance part of the predetermined length (e.g., for one beat) among the music data for performance, and determines the sounding timing, tone color, effect, pitch change, etc. Further, the controller 1 determines the sounding intensity in accordance with the Velocity information in the Note On message. The performance information in the music data for performance contains information indicating the sound volume, but the sounding intensity is determined by multiplying the sound volume by the Velocity information. Specifically, although the music data for performance already includes sound volume information taking account of a volume representation (sound dynamics) for the music, a dynamics representation that varies depending on the user's key depression intensity is added, whereby the sounding intensity is determined.

When the Note Off message is input, the controller 1 times a time period from the reception of the Note On message to the reception of the Note Off message. Music sound sounded first is continued to be produced until the Note Off message is input. When the Note Off message is input, the tempo in the concerned beats and the length of each music sound are determined, and the next music sound is sounded.

Although the tempo may simply be determined based on the time period from the Note On to the Note Off (referred to as the Gate Time), the tempo can be determined as follows. The moving average of the Gate Time is calculated for a plurality of key depressions (immediately preceding key depressions) and weighted by time. The weight is the heaviest on the last key depression. The earlier the key depression is, the lighter the weight thereon is. By determining the tempo in this manner, a sudden tempo change can be prevented, even if one key depression causes a significant change in the Gate Time. Therefore, the tempo can smoothly be changed according to the flow of the music, without causing uncomfortable feeling.

In the performance terminal 2, the controller 22 receives the sounding instruction data determined as described above by the controller 1, and instructs the tone generator 24 to generate a sound waveform. The tone generator 24 generates a sound waveform and reproduces music sounds from the speaker 25. The above described processing is repeated every time each user depresses the keyboard 23. Thus, music performance can be made by depressing the keyboard 23, for example, on every beat.

As described above, the music sound sounded first is continued to be produced until a Note Off message is input. Therefore, the same music sound is kept produced until the user lifts his finger from the keyboard 23, whereby a sustained-sound representation (fermata) can be realized in the ensemble system.

It is also possible to realize the following performance representation by determining the tempo, as described above, based on the moving average of the Gate Time. For example, when a key depression is performed shortly on the keyboard 23, the length of each sound for the corresponding beats is made short, whereas when the keyboard 23 is depressed for a long duration, the length of each sound for the corresponding beats is made long. As a result, the performance representation of crisp sounds (staccato) without a significant change in the tempo can be realized, and the performance representation of sustained sounds (tenuto) without a significant change in the tempo can also be realized.

In this embodiment, the Note On and Note Off messages are transmitted to the controller 1 irrespective of which keyboard 23 of the performance terminals 2A to 2F is depressed. Alternatively, the keyboards 23 may be divided into those that enable the staccato and tenuto and those that do not. The controller 1 may change the length of sound while maintaining the tempo only when the Note On and Note Off messages are input from specific keyboards (e.g., E3).

Figure 6:
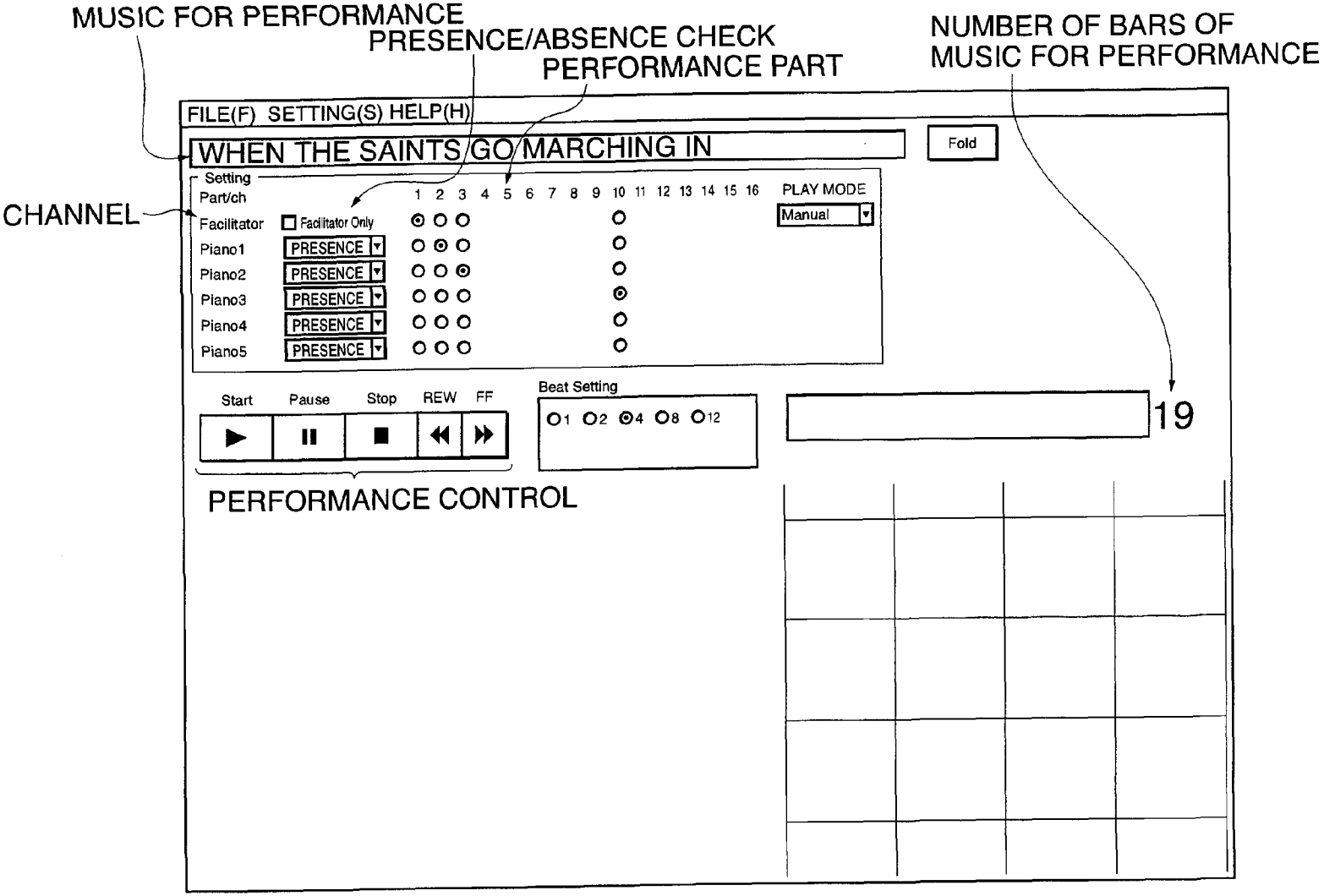
FIG. 6 is a view showing a main operation window.

Next, an explanation will be given of a user interface shown on the display unit 16. Referring to FIG. 6, a main operation window is displayed on the display unit 16. In a text field in an upper part of this window, the name of music data for being performed, which is selected by the user, is shown. In a "Setting" field, the performance terminals (Facilitator and Pianos 1 to 5) are indicated. For each of the performance terminals, a pull-down menu for selection of presence/absence and radio buttons for performance part assignment are shown. The performance terminals (Facilitator and Piano 1 to 5) are associated with MIDI ports of the MIDI interface box 3.

The selective input to the presence/absence pull-down menus is performed by the facilitator according to the presence or absence of the educands. The radio buttons are shown only for performance terminals to which performance parts of the music data for performance are respectively assigned.

In the example shown in FIG. 6, performance parts 1, 2, 3, and 10 are set for the selected music data for performance. When this music data for performance is selected, the performance terminals "Facilitator", "Piano l", "Piano 2" and "Piano 3" are automatically assigned to respective ones of the performance parts 1, 2, 3, and 10. In FIG. 6, the selected music data for performance includes only four performance parts, and therefore, these performance parts are assigned only to the performance terminals "Facilitator" and "Pianos 1 to 3". On the other hand, in the case, for example, that the music data for performance includes six performance parts, these performance parts are respectively assigned to the performance terminals "Facilitator" and "Pianos 1 to 5". In the case that there are performance parts greater in number than the MIDI ports (performance terminals), more than one performance parts are assigned to the performance terminal "Facilitator". The user (facilitator) operating the controller 1 can manually select, by the radio button selection, respective performance parts for desired performance terminals. When a checkbox "Facilitator Only" is selected, all the performance parts are assigned to the performance terminal "Facilitator". No radio button is displayed for performance terminals 2 set as "absent" on the pull-down menus, so that no performance part is assigned to these performance terminals 2.

In the case that the performance part assignment is automatically implemented based on the table shown in FIG. 5, if there is a performance terminal for which the "absence" is selected on the presence/absence pull-down menu, a performance part scheduled to be assigned to the absent performance terminal is assigned to the performance terminal "Facilitator". In that case, the performance part for the "absent" performance terminal may be assigned to another performance terminal, instead of a performance part scheduled to be assigned to the other performance terminal and close in tone color or role to the performance part for the absent performance terminal (for example, the part scheduled to be assigned to the absent terminal is a drums part, and the part scheduled to be assigned to the other terminal is a base part, string instrument part, or the like). The relation between relevant performance parts may be specified in advance in the table.

Figure 7:
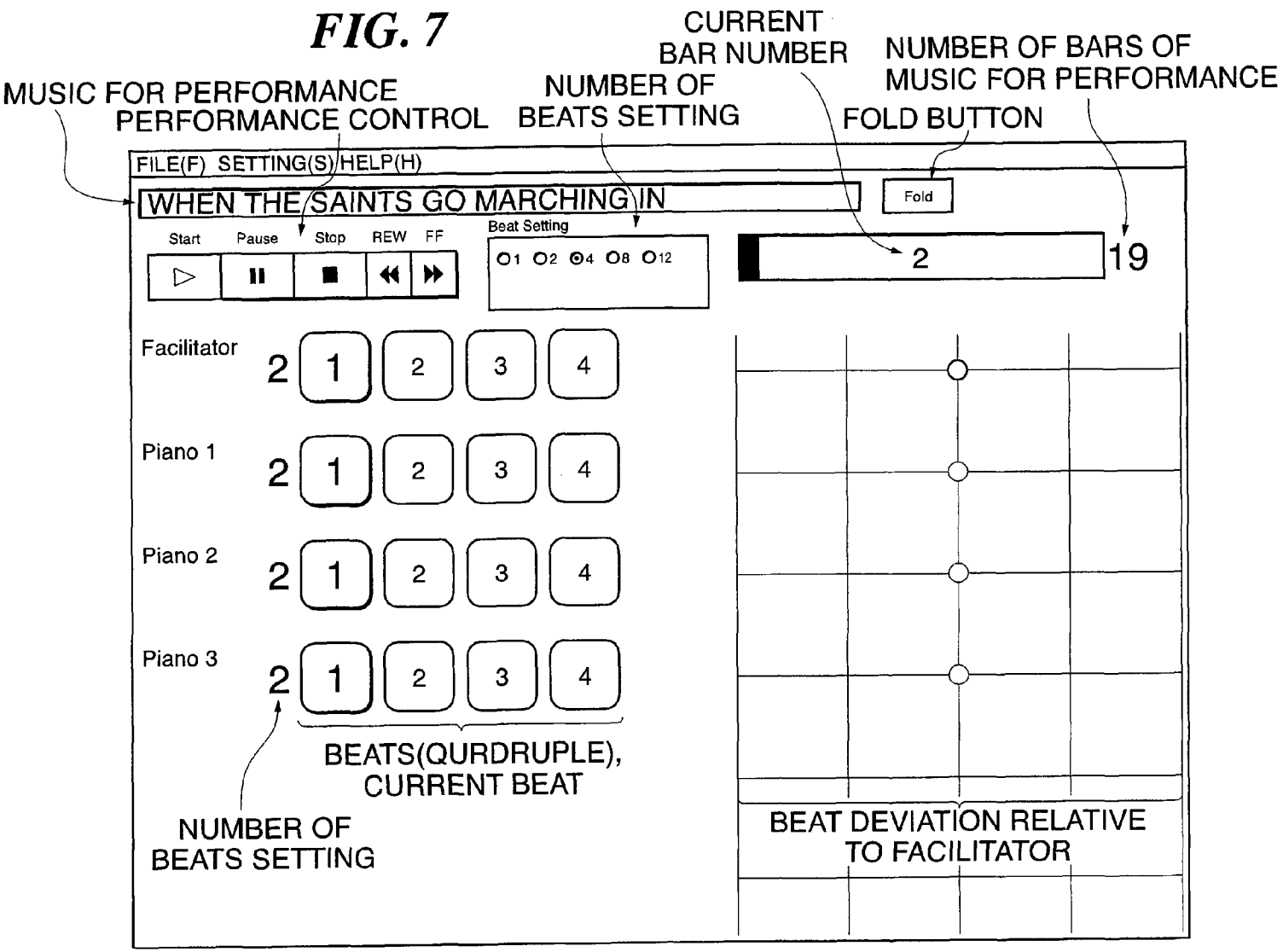
FIG. 7 is a view showing an ensemble window.
Figure 8A:
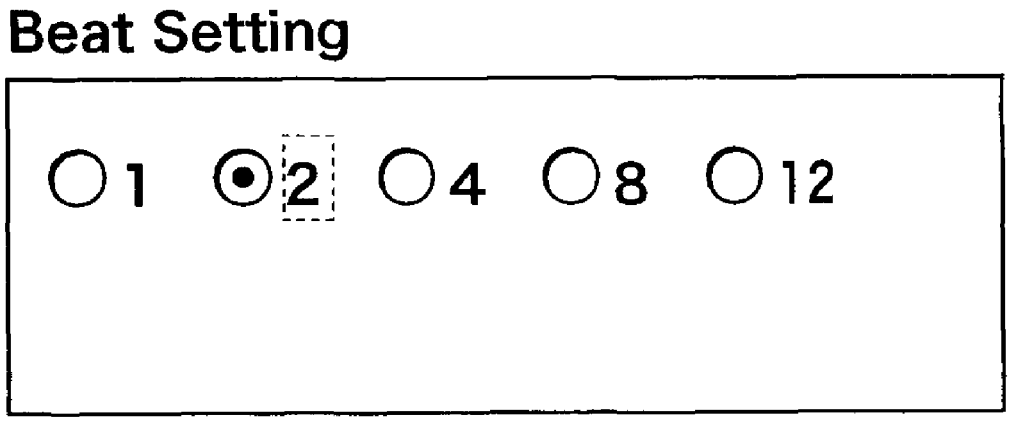
FIG. 8A is a view showing the setting of the number of beats.

When a Start button among performance control buttons displayed on the left side of the middle of the window is depressed after execution of the performance part assignment, performance-start standby is achieved, and an ensemble window shown in FIG. 7 is displayed on the display unit 16. Also in this window, the name of the selected music data for performance is displayed in an upper text field. On the upper right side of the window, there are displayed the number of bars included in the selected music data for performance and the current bar number at which the performance is currently performed. In a number of beats field (Beat Setting) displayed on an upper part of the middle of the window, radio buttons for setting the number of beats in one bar are shown. In FIG. 7, the number of beats is set to four, and the music data is performed at four-four time (four beats per bar). In that case, a key depression will be made on every beat. When a two-beat button is selected for the music being performed as shown in FIG. 8A, a key depression will be made on every other beat, and the first and third beats will be the key depression timing. In that case, in response to the transmission of Note On and Note Off messages from the performance terminal 2, the controller 1 returns sounding instruction data of the length of two beats. That is, the performance will be performed for the length of two beats in response to one key depression.

Figure 8B:
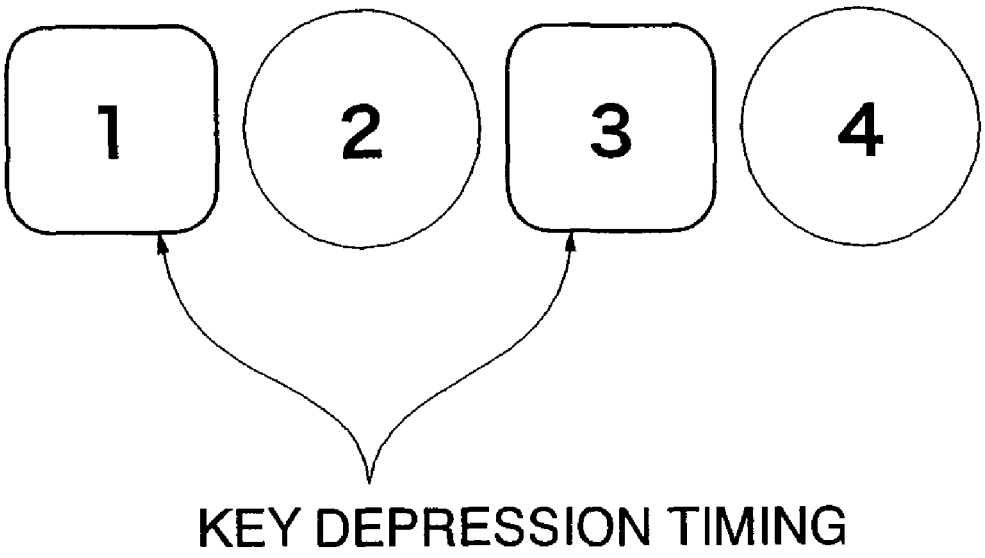
FIG. 8B is a view showing an example of icon representations of beats (first and third beats) corresponding to key depression timing and beats (second and fourth beats) not corresponding to key depression timing.

Referring to FIG. 7, the current bar number, the number of beats in the bar (the number of times the key depression should be made in the bar), and the current beat (current key depression timing) for each of the performance terminals (Facilitator, Piano 1, Piano 2, and Piano 3) are displayed on the left side of the middle of the ensemble window. As shown in FIG. 7, the number of times the key depression should be made is represented by rectangular icons each having a numeral therein, and the current beat is represented by a three-dimensional rectangular icon or a bold icon. The way of representation is not limited to using these icons described in this example, but differently shaped icons may be used. As shown in FIG. 8B, the beats deviated from key depression timing (i.e., the second and fourth beats) are each indicated by a differently shaped icon such as a circular icon having a numeral therein.

Figure 9:
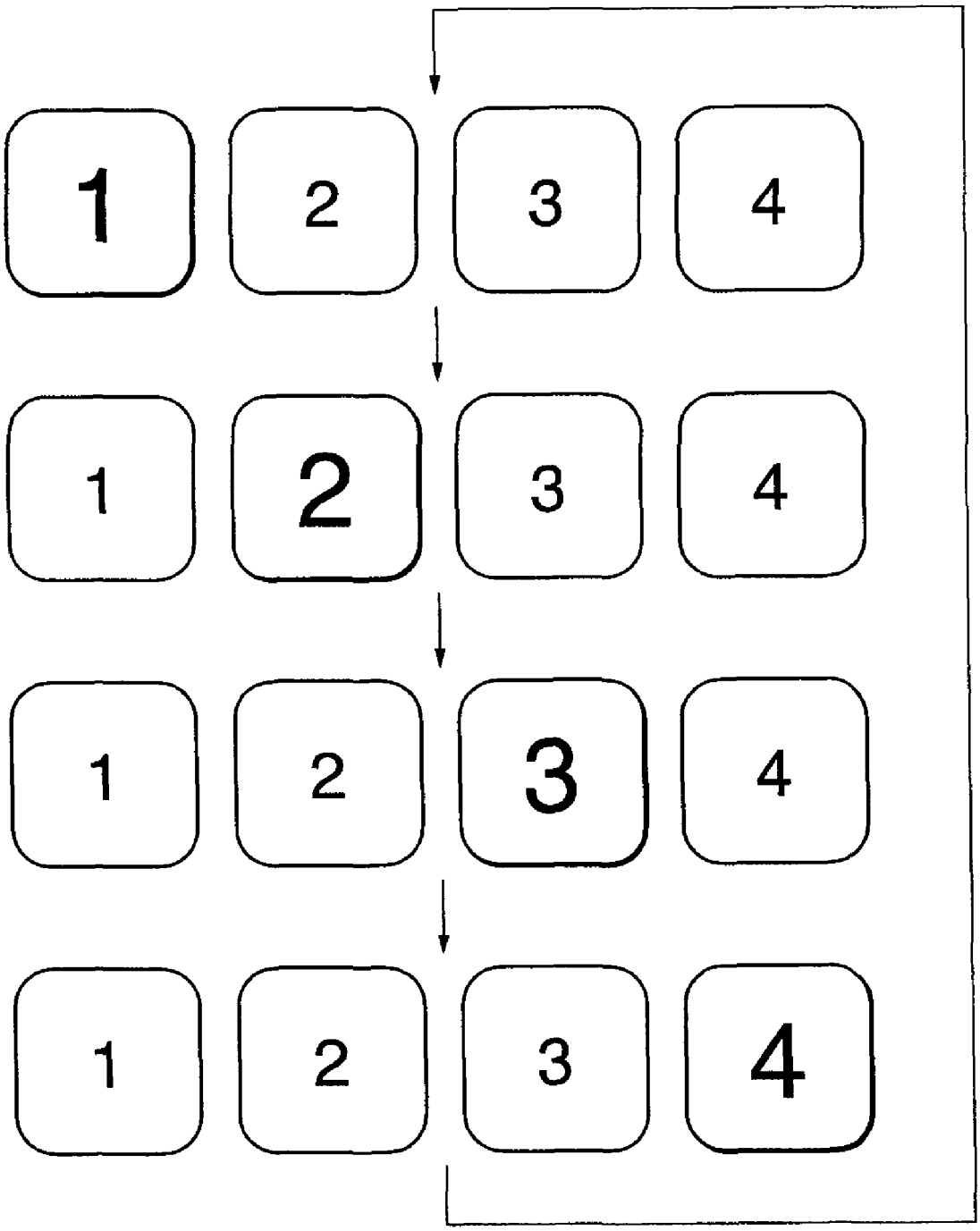
FIG. 9 is a view showing a shift of current beat.

Upon each key depression by the user, the current beat shifts one by one as shown in FIG. 9. Specifically, the beat represented by the three-dimensional rectangular icon or the bold icon shifts between the first, second, third, and fourth beats in this order on every key depression. In this example, the music data of four-four time is used for performance, and therefore, subsequently to the key depression on the fourth beat, the current beat is returned to the first beat, whereby the music data is advanced by one bar.

The control unit 12 of the controller 1 detects a beat deviation (key depression timing) at each of the performance terminals. Specifically, the control unit 12 detects a deviation between the progression of the performance part assigned to the facilitator performance terminal 2 and the progression of the performance part assigned to each of the other performance terminals. Based on results of the detection, a window shown in FIG. 7 is displayed on the display unit 16.

Referring to FIG. 7, a field for indicating a beat deviation relative to the beat of the performance terminal "Facilitator" is displayed on the right side of the middle of the window. In this field, a plurality of (for example, five) vertical lines are shown, and lateral lines are shown such as to correspond to respective ones of the performance terminals. In addition, there are shown circular marks respectively corresponding to these performance terminals. Each circular mark indicates a deviation relative to the performance terminal "Facilitator".

Figure 10:
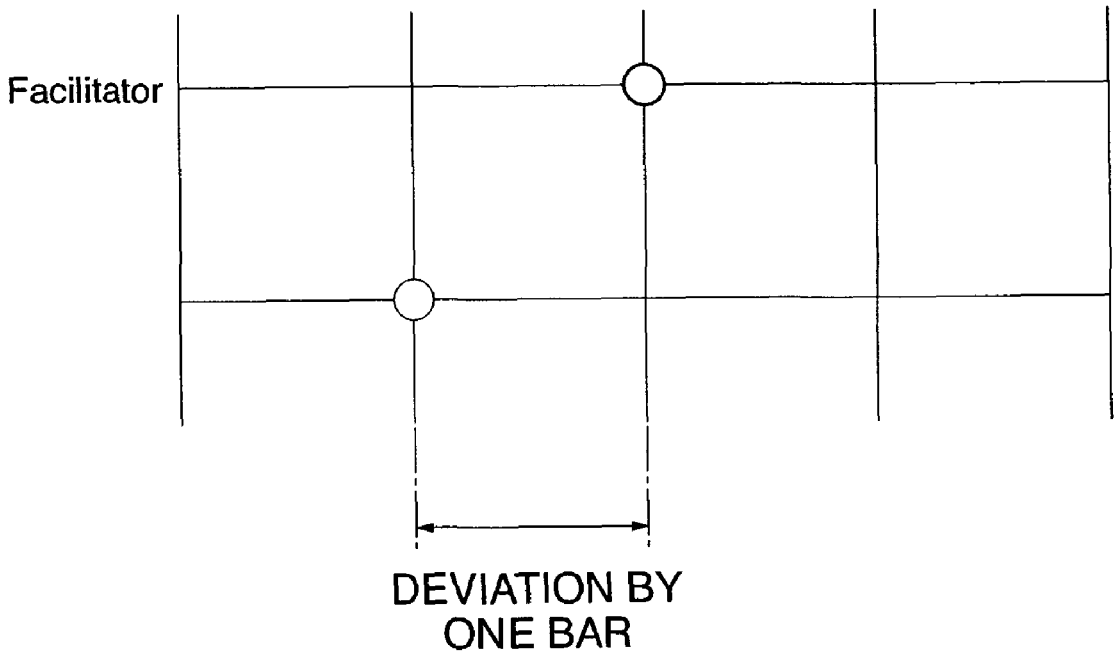
FIG. 10 is a view for explaining a beat deviation relative to a performance terminal "Facilitator"

FIG. 10 is a view for explaining a beat deviation relative to the performance terminal "Facilitator". As shown in FIG. 10, the circular mark corresponding to the performance terminal "Facilitator" is fixedly shown on the center line among the vertical lines, and each of the circular marks respectively corresponding to user's performance terminals (for example, the circular mark corresponding to "Piano 1") is moved to the left and the right according to the beat deviation relative to the performance terminal "Facilitator". For example, when the key depression is lag behind the key depression on the performance terminal "Facilitator" by one bar (four beats in this example), the circular mark is moved leftward by one vertical line as shown in FIG. 10. If there is a delay of one-half bar (two beats), the circular mark is moved leftward from the center vertical line by a distance equal to half an interline distance. On the other hand, if the key depression leads the key depression on the performance terminal "Facilitator", the circular mark is moved rightward. In FIG. 10, there are displayed two lines with respect to the center line on each side, left and right, and therefore, a beat deviation of up to two bars can be displayed. If there occurs a beat deviation of more than two bars, the icon is changed (into, for example, a rectangular icon) at the left or right end of the line. As a result, each user can easily recognize a deviation of performance (beat) from that of the facilitator.

It should be noted that a reference performance terminal is not limited to the performance terminal "Facilitator". An amount of beat deviation may be displayed with reference to any of the performance terminals 2.

The field for indicating the beat deviation relative to the performance terminal "Facilitator" is not limited to the above described example where it is displayed on the display unit 16 of the controller 1, but can be displayed on a display unit (not shown) for performance terminal, which is provided in each of the performance terminals 2.

As described above, a beat deviation, i.e., a deviation in the number of times of key depression on each performance terminal 2 can be ascertained at a glance, which makes it possible for each participant to easily recognize the degree of deviation of his/her performance from the facilitator's performance. Furthermore, the facilitator can easily grasp a deviation of each participant's performance, and therefore can teach each participant about whether the participant's performance should be speeded up or slowed down. In accordance with the degrees of participant's deviations, the facilitator may change a tempo of the facilitator's performance. Even in that case, the circular mark corresponding to the performance terminal "Facilitator" in FIG. 10 is fixedly shown on the center line, whereas each of the circular marks corresponding to the participants is moved to the left and the right according to a deviation of each participant's performance relative to the tempo-adjusted performance by the performance terminal "Facilitator". In the window display, even when the reference tempo has been changed, the circular mark corresponding to the performance terminal "Facilitator" is fixed at the center position, and the circular mark for each participant's performance is displayed such as to indicate a deviation relative to the reference. The participants can enjoy a participant-oriented ensemble performance much more than when they perform an ensemble performance to follow a demonstrative performance (automatic mechanical performance).

Upon depression of a Pause button among performance control buttons displayed on the left side of the middle of the window in FIG. 7, performance is temporarily terminated, whereby a state of temporary termination is achieved where no music sound is sounded even when a key depression is performed on any of the performance terminals 2. When the Pause button has been depressed and the temporary termination state has been achieved, even if a Note On message is input from any of the performance terminals 2, the controller 1 does not transmit sounding data to that performance terminal 2. Subsequently, when the Pause button is depressed again or a Start button is depressed in this state, the temporary termination state is released. If a Note On message is received subsequently, sounding data is transmitted to the performance terminal 2 concerned.

When a Stop button among the performance control buttons is depressed, the performance is completed, and a shift is made to the main operation window shown in FIG. 6. It should be noted that when a Fold button displayed on the upper right side of the window in FIG. 7 is depressed, a shift to the main operation window in FIG. 6 is made without the performance being completed (with the current beat kept unchanged). When the Fold button in the main operation window is depressed again, the ensemble window in FIG. 7 is returned.

When an FF button among the performance control buttons in FIG. 7 is depressed, a fast-forward state is achieved. When the FF button has been depressed and the fast-forward state has been achieved, the controller 1 reads out, at a speed (e.g., quadruple speed) higher than the normal speed, the performance parts assigned to all the performance terminals 2 connected to the controller, and transmits sounding data to each of the performance terminals 2. While the fast-forward state is maintained, the controller 1 continues to transmit the sounding data. When the FF button is depressed again and the fast-forward state is released, the transmission of the sounding data is stopped.

For the quadruple-speed readout, a history of performance speed in the performance terminal "Facilitator" (moving average of Gate Time) may be referred to, and the readout may be made at a speed four times faster than the performance speed referred to. Alternatively, the readout may be made at a speed four times faster than a reproduction speed (tempo data) written in advance in music data for performance.

When an REW button is depressed, a rewind state is achieved. When the REW button has been depressed and the rewind state has been achieved, the controller 1 reads out, in a reverse time sequence, data of performance parts read out in past time and assigned to all the performance terminals 2 connected to the controller, and transmits the data to the performance terminals 2. Specifically, the controller 1 handles Note Off events as Note On events and handles Note On events as Note Off events in the music data for performance, which is MIDI data. The readout may be made at a speed higher than a normal speed (quadruple speed, for example) or at the normal speed. While the rewind state is maintained, the controller 1 continues to transmit sounding data in reverse time sequence. When the REW button is depressed again and the rewind state is released, the sounding data transmission is stopped.

It should be noted that in the rewind state, sounding may be performed with Note On events remained unchanged. In the high-speed (quadruple-speed) rewind state, the reproduction speed becomes high to an extent that each sound cannot be perceived. Thus, even when the reproduction is made in a reverse time sequence, some "squeaky" scanning sound can only be heard and the reproduction can be performed without causing uncomfortable feeling.

The fast-forward or rewind can be performed individually for each performance terminal using the keyboard 23 of the performance terminal 2 concerned. By depressing a particular keyboard (for example, C2, C3, or the like), each user can instruct the execution of fast-forward or rewind. When a Note On or Note Off message from the fast-forward keyboard is input from one of the performance terminals 2, the controller 1 reads out the performance part assigned to that performance terminal 2 at a speed higher than the normal speed, and transmits sounding data. While the fast-forward state is maintained, the controller 1 continues to transmit sounding data. Subsequently, when a Note On or Note Off message from the fast-forward keyboard is input again from that performance terminal 2, the sounding data transmission is stopped. Similarly, when a Note On or Note Off message from the rewind keyboard is input from one of the performance terminal 2, the controller 1 reads out the performance part assigned to that performance terminal 2 in a reverse time sequence, and transmits sounding data. At that time, the readout may be performed at a speed higher than the normal speed or at the normal speed. While the rewind state is maintained, the controller 1 continues to read out the performance part in a reverse time sequence and transmit sounding data. When a Note On or Note Off message from the rewind keyboard is input again from that performance terminal 2, the sounding data transmission is stopped.

During the fast-forward or the rewind, the controller 1 may transmit sounding data for generating quasi-scanning sound, without transmitting sounding data of music sound for performance. For example, the quasi-scanning sound may be "squeaky" sound or the like. Even in that case, the key depression timing (readout of music data for performance) is made advanced or retarded at a high speed.

It should be noted that the fast-forward or rewind state may be stopped when the key depression timing in each performance terminal 2 reaches the current key depression timing in the facilitator's performance terminal 2. The controller 1 stops the sounding data transmission when the key depression timing in each performance terminal 2 being fast-forwarded or rewound reaches the same timing as the key depression timing (the readout timing of music data for performance) in the facilitator's performance terminal 2.

The fast-forward or rewind for each performance terminal 2 can also be implemented using the operation unit 15 of the controller 1. Although not shown, the FF and REW buttons can be displayed for each performance terminal in the ensemble window in FIG. 7.

To perform the fast-forward or rewind for each performance terminal 2, a history of performance speed (moving average of Gate Time) in each performance terminal may be referred to, and the performance part may be read out at a speed four times faster than the performance speed referred to. Alternatively, the readout may be made at a speed four times faster than the performance speed in the facilitator's performance terminal 2, or at a speed four times faster than tempo data indicated in advance in music data for performance.

With the ensemble system of this embodiment, a one-touch adjustment to attain the same key depression timing as the key depression timing in the facilitator's performance terminal 2 can be achieved by a key depression on a particular keyboard (for example, G2 or the like), which is different from that for the fast-forward or rewind keyboard. When a Note On or Note Off message from the particular keyboard (G2 keyboard) is input from a performance terminal 2, the controller 1 moves a point to the same key depression timing as the key depression timing in the facilitator's performance terminal 2. In the next time, when a Note On message from a performance operation keyboard (for example E3) is input from that performance terminal 2, the performance part at the same key depression timing as the current key depression timing in the facilitator's performance terminal 1 is read out, and sounding data is transmitted. Therefore, even when the performance terminal 2 lags behind or leads the facilitator's performance terminal 2 in terms of key depression timing, a one-touch movement to the same key depression timing can be achieved.

Figure 11:
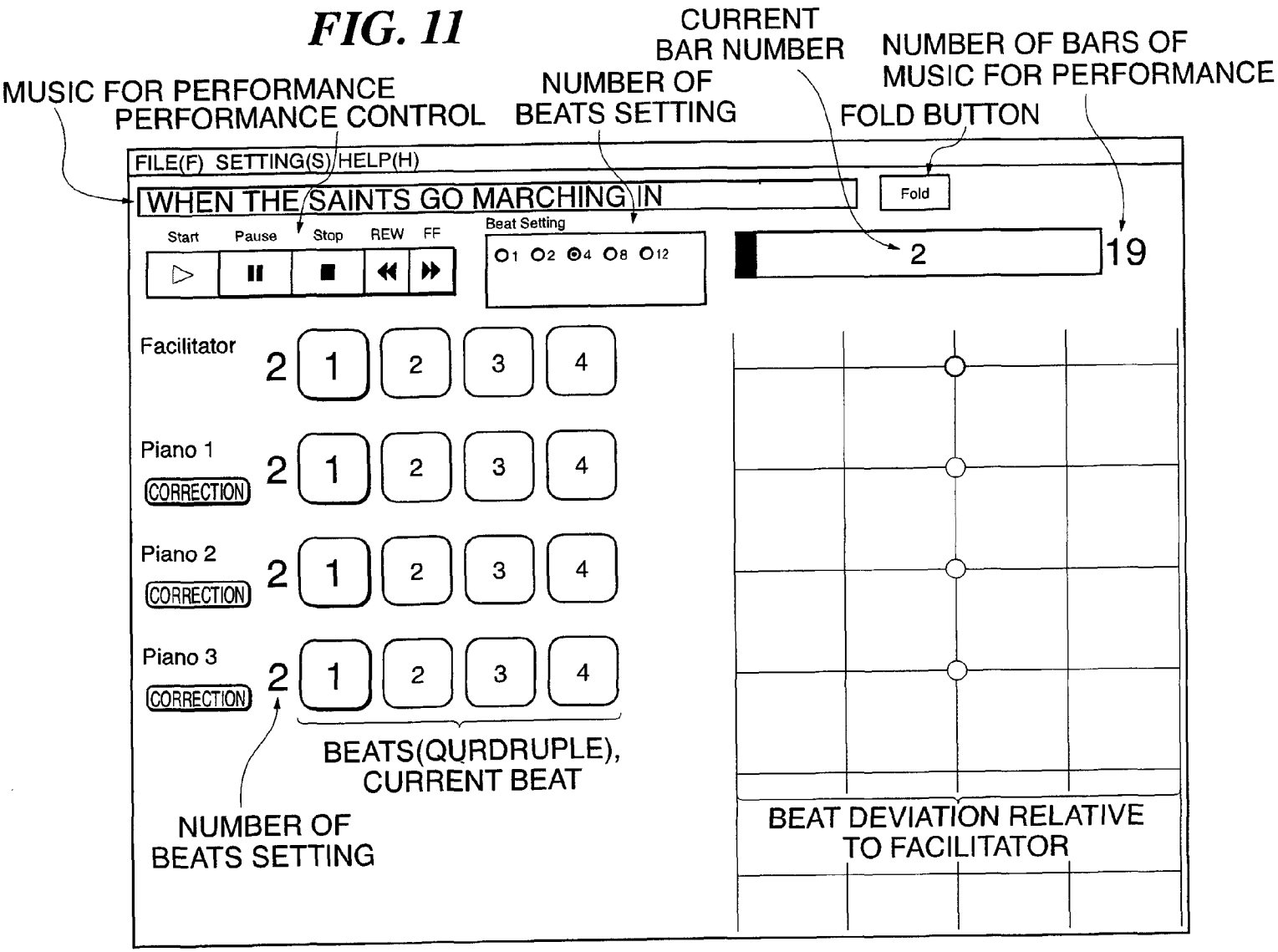
FIG. 11 is a view showing an ensemble window including a "correction" button.

The one-touch movement can also be carried out using the operation unit 15 of the controller 1. As shown in FIG. 11, a "correction" button to adjust the key depression timing to the same timing as the key depression timing in the facilitator's performance terminal 2 can be displayed for each performance terminal in the ensemble window.

As described above, each user can implement the performance by performing simple operations such as depressing the keyboard with a finger, and an ensemble performance can be carried out by the users, while enjoying themselves, by making operations in such a way as to reduce a deviation of performance (beat) displayed on the display unit 16 from that of the performance terminal "Facilitator". As described above, a deviation relative to the facilitator's performance terminal 2 (reference performance terminal) is not displayed finely in units of musical note, but displayed in terms of a deviation of the number of times of key depression, whereby even a person unfamiliar with musical instrument operation can easily grasp the deviation. Furthermore, when a performance deviation becomes excessively large and as a result, it is difficult to adjust the performance to that of the facilitator, such a performance deviation can easily be corrected by the "fast-forward" button, "rewind" button, correction button, or the like. Thus, the users can enjoy playing an ensemble performance without causing a disruption.

It should be noted that a deviation of the number of times of key depression is displayed in this embodiment, but a deviation of dynamics, a deviation of performance nuance, or other deviation can also be displayed. A deviation of dynamics may be calculated based on a Velocity value input from each performance terminal 2, and a deviation of performance nuance may be calculated based on a Gate Time value in each performance terminal 2.

INDUSTRIAL APPLICABILITY

With this invention, a performance deviation (a deviation of the number of times of key depression) relative to the facilitator can be displayed, and even a performer unfamiliar with operating a musical instrument can easily grasp his/her own deviation in performance. Thus, the performer can easily adjust his/her performance. Furthermore, the facilitator can also easily grasp a deviation of each participant in performance, and therefore can teach each participant about whether his/her performance should be speeded up or slowed down. Alternatively, the facilitator can adjust his/her own tempo such as to coincide with those of the participants.

The invention claimed is:

1. An ensemble system comprising:

a plurality of performance terminals each having at least one performance operator unit for performance operation by a user;

at least one tone generator; and a controller connected to the plurality of performance terminals and the at least one tone generator to control each of the performance terminals, wherein the controller includes:

a storage device that stores music data for performance including a plurality of performance parts;

an operation unit that gives instructions to start and complete a performance;

a performance control unit that assigns the plurality of performance parts to respective ones of the plurality of performance terminals, reads out the performance part assigned to each of the performance terminals in accordance with a way in which the performance operator unit of the respective performance terminal is operated, and outputs performance data representing the read-out performance part to the tone generator;

a deviation detecting unit that detects, for each of the performance terminals, a deviation between the progression of the performance part read out from a guiding performance terminal, which is assigned from one of the plurality of performance terminals in accordance with a way in which the performance operator unit of the guiding performance terminal is operated and the progression of the performance part read out from each of other performance terminals in accordance with a way in which the performance operator unit of the each of the other performance terminals is operated; and a display unit that displays the deviation between the progression of the performance part read out from the guiding performance terminal and the progression of the performance part read out from each of the other performance terminals.

2. The ensemble system according to claim 1, wherein:

the tone generator is built in to each of the plurality of performance terminals, and the performance control unit of the controller outputs performance data of the performance part read out to the tone generator built in to the performance terminal to which the performance part is assigned.

3. The ensemble system according to claim 1, wherein:

the controller further includes a fast-forward instruction control that gives a fast-forward instruction for at least one performance part assigned to at least one of the performance terminals, and the performance control unit reads out at a high speed the at least one performance part assigned to the at least one of the performance terminals when the fast-forward instruction is given by the fast-forward instruction control.

4. The ensemble system according to claim 1, wherein:

each of the performance terminals includes a terminal fast-forward instruction control that gives a fast-forward instruction for at least one of the performance parts assigned to each of the performance terminals, and the performance control unit, when given the fast-forward instruction, reads out at a high speed at least one of the performance parts assigned to the performance terminal given the terminal fast-forward instruction.

5. The ensemble system according to claim 1, wherein:

the controller further includes a rewind instruction control that gives a rewind instruction for at least one of the performance parts assigned to at least one of the performance terminals, and the performance control unit, when given the rewind instruction by the rewind instruction control, reads out in a reverse sequence the at least one performance part previously read out for the at least one performance terminal.

6. The ensemble system according to claim 1, wherein:

each of the performance terminals includes a terminal rewind instruction control that gives a rewind instruction for at least one of the performance parts assigned to each of the performance terminals, and the performance control unit reads out, in a reverse sequence, the at least one performance part for the performance terminal given the terminal rewind instruction.

7. The ensemble system according to claim 1, wherein:

the controller includes a deviation correcting instruction unit that gives an instruction to eliminate any deviation in performance between at least one of the performance terminals and the guiding performance terminal, and the performance control unit, when given the instruction to eliminate any deviation in performance by the deviation correcting instruction unit, reads out at least one of the performance parts assigned to the at least one performance terminal to make progress of the at least one read out performance part assigned to the at least one of the performance terminals to coincide with the progress of the corresponding read out performance part assigned to the guiding performance terminal.

8. The ensemble system according to claim 1, wherein:

each of the performance terminals includes a terminal deviation correcting instruction unit that gives an instruction to eliminate any deviation in performance between each of the performance terminals and the guiding performance terminal, and the performance control unit, when given the instruction to eliminate the deviation in performance by the terminal deviation correcting instruction unit of one of the performance terminals, reads out the at least one performance part assigned to the at least one performance terminal to make progress of the at least one read out performance part assigned to the at least one performance terminal to coincide with the progress of the corresponding read out performance part assigned to the guiding performance terminal.

* * * * *